US005513853A

United States Patent [19]

Crompton et al.

[11] Patent Number: 5,513,853

[45] Date of Patent: May 7, 1996

[54] AMUSEMENT MACHINE

[75] Inventors: Gordon Crompton; Simon Osborn; Maurice Burton, all of Kent, England

[73] Assignee: Cromptons Leisure Machines Limited, Kent, United Kingdom

[21] Appl. No.: 256,985

[22] PCT Filed: Jan. 29, 1993

[86] PCT No.: PCT/GB93/00203

§ 371 Date: Jul. 29, 1994

§ 102(e) Date: Jul. 29, 1994

[87] PCT Pub. No.: WO93/15481

PCT Pub. Date: Aug. 5, 1993

[30] Foreign Application Priority Data

Jan. 31, 1992 [GB] United Kingdom ..... 9202081

[51] Int. Cl.[6] ..... A63F 9/00

[52] U.S. Cl. ..... 273/448; 221/210

[58] Field of Search ..... 273/441, 442, 273/448, 447, 454, 446; 221/210; 212/232; 194/350; 446/226, 229, 424, 426

[56] References Cited

U.S. PATENT DOCUMENTS

| | | | |
|---|---|---|---|
| 1,509,295 | 9/1924 | Holcomb et al. | 212/232 X |
| 1,770,305 | 7/1930 | Fleisher | 221/210 X |
| 1,855,444 | 4/1932 | Fey | 221/210 X |
| 1,888,050 | 11/1932 | Rabkin et al. | 221/210 X |
| 3,393,469 | 7/1968 | Balthazor | 446/426 |
| 4,712,968 | 12/1987 | Manning | 446/426 X |
| 4,726,585 | 2/1988 | Shoemaker . | |

FOREIGN PATENT DOCUMENTS

| | | | |
|---|---|---|---|
| 1177535 | 9/1964 | Germany . | |
| 8629981 | 1/1987 | Germany . | |
| 5115614 | 5/1993 | Japan | 273/448 |
| 455355 | 10/1936 | United Kingdom | 221/210 |
| 2223179 | 4/1990 | United Kingdom . | |

*Primary Examiner*—Paul E. Shapiro
*Attorney, Agent, or Firm*—Lowe, Price, LeBlanc & Becker

[57] ABSTRACT

The invention relates to an amusement machine comprising a play area (3) for containing a plurality of small portable articles (30) which are accessible from above; a scoop means (4) remotely operable by a user of the machine for scooping articles from the play area (3) and transferring them directly or indirectly to a collection station (7); a sensor means (26) for detecting the amount of articles at the collection station (7); and a dispenser for dispensing a cash or non-cash prize in response to a signal from the sensor (26).

3 Claims, 9 Drawing Sheets

FIG.1A.
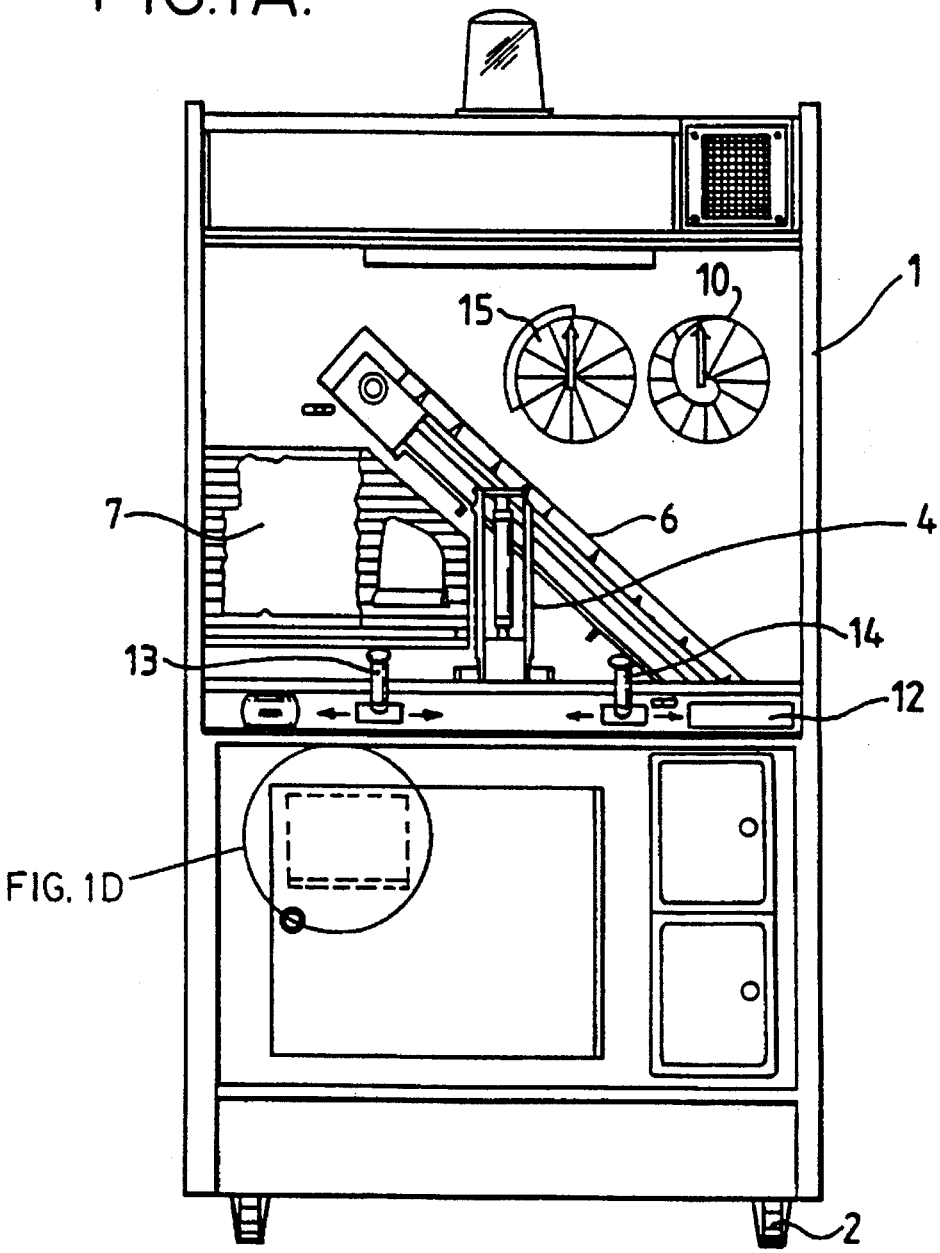
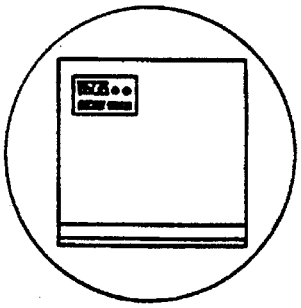
FIG.1D.

FIG. 2A.
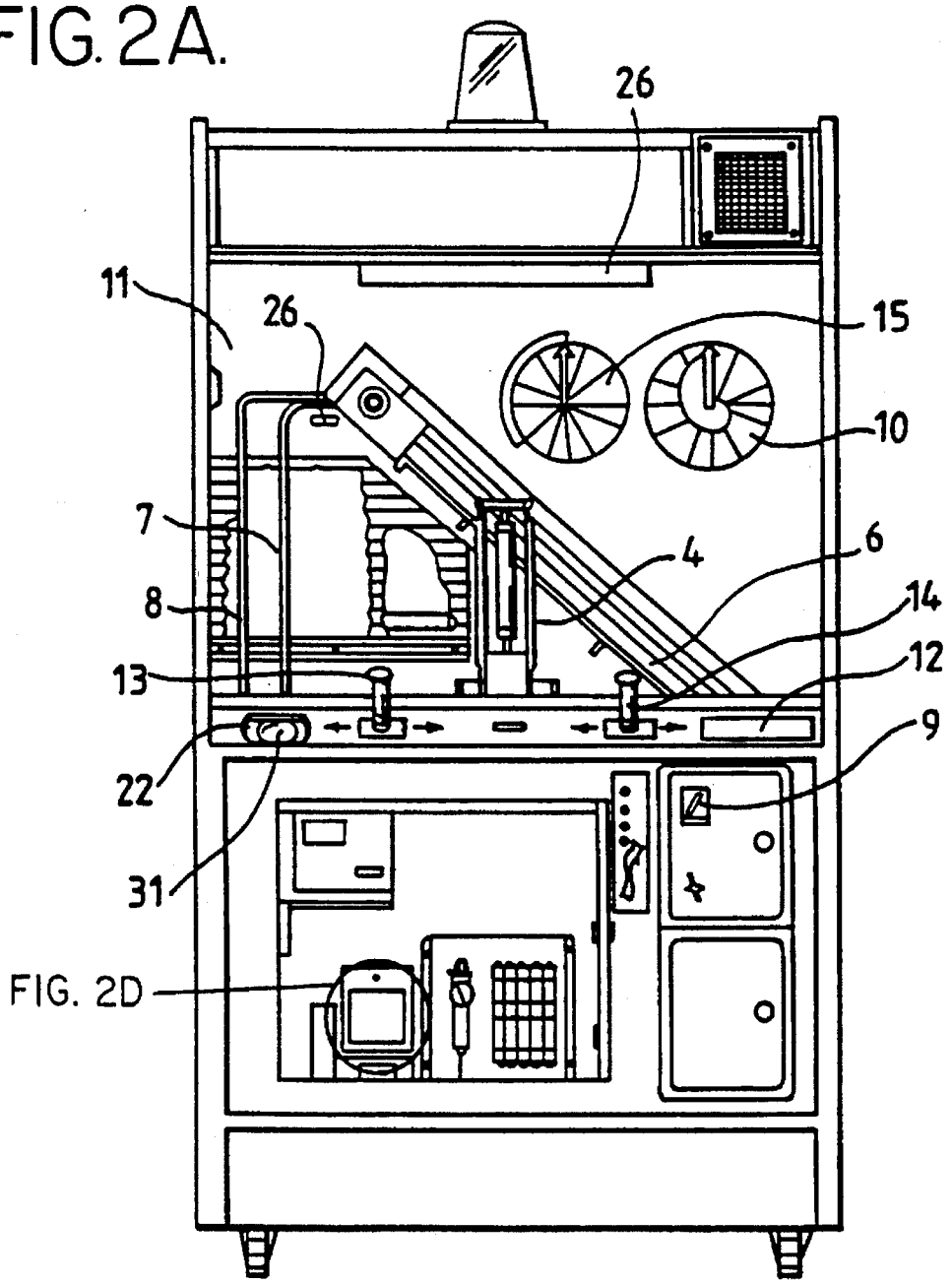
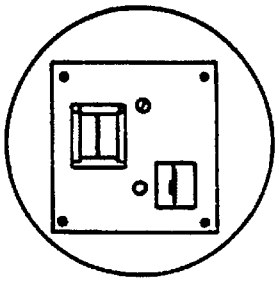
FIG. 2D.

AMUSEMENT MACHINE

According to the invention, there is provided an amusement machine comprising a play area for containing a plurality of small portable articles which are accessible from above; scoop means remotely operable by a user of the machine for scooping articles from the play area and transferring them directly or indirectly to a collection station; sensor means for detecting the amount of articles at the collection station; and dispensing means for dispensing a cash or non-cash prize in response to a signal from the sensor means.

In addition, the amusement machine preferably comprises some or all of the following further features. The small portable articles are balls, for example made of plastic (e.g. nylon) or metal. A collector chute is provided close to the play area for receiving balls from the scoop means, and a continuously moving conveyor system receives the balls from the collector chute and transports them into a collector hopper which constitutes the collection station.

The machine is preferably coin- or counter-operated. On insertion of a coin, the user is able to operate the scoop means for a fixed time. The prize dispensed is then in proportion to the number of balls collected at the collection station in the fixed time, and the number of balls collected is measured by the sensor means. Instead of dispensing a prize immediately, the user may gain a "credit" which counts towards a more valuable prize on further use of the machine. After each time of use has expired, balls which have collected at the collecting station are returned to the play area.

In one embodiment, the prize is a small article enclosed in a spherical capsule (hereinafter called a prize capsule) and is dispensed into the play area, from which the user of the machine may retrieve it by use of the scoop means. The prize capsule will preferably be of larger diameter than the regular small balls, so that it can be distinguished from them by the machine mechanism.

Reference is now made to the accompanying drawings, in which:

FIGS. 1A, 1B and 1C respectively show a front view, side view and rear view of a machine according to a preferred embodiment of the invention; FIG. 1D is a detail view taken from line 1D of FIG. 1A.

FIGS. 2A, 2B, 2C and 2D correspond respectively to FIGS. 1A, 1B, 1C and 1D and show the location of sub-assemblies;

FIGS. 3(A)–3(D) show the function of a pneumatic digger arm which constitutes the scoop means in the machine;

Figure 6B:
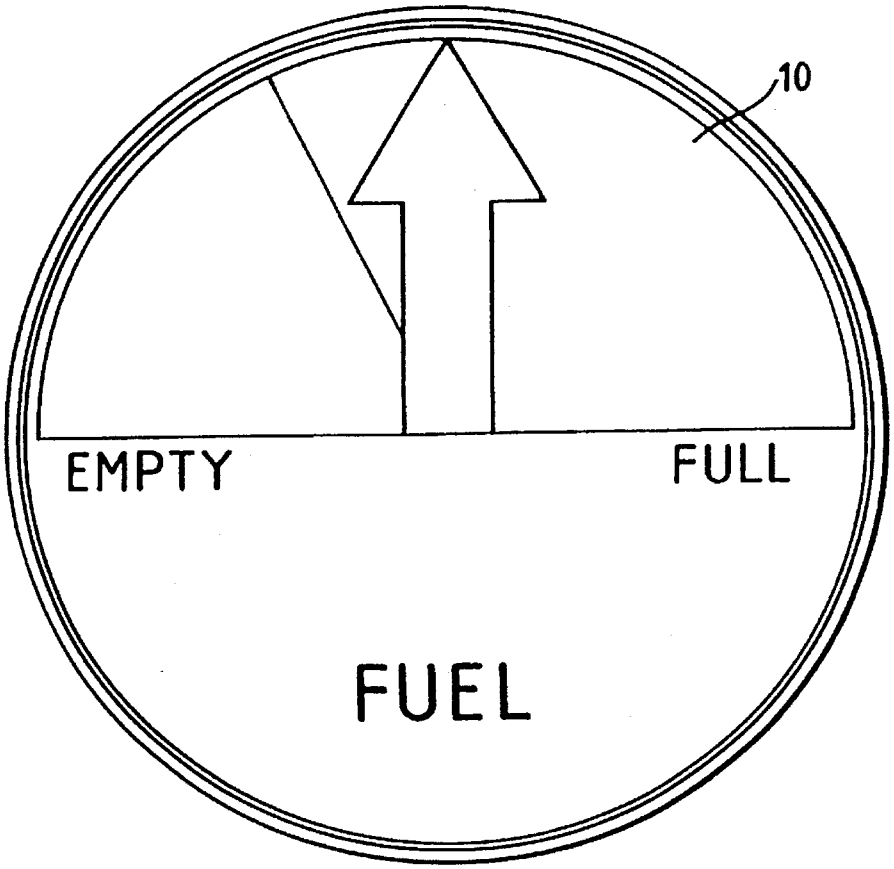
Figure 6A:
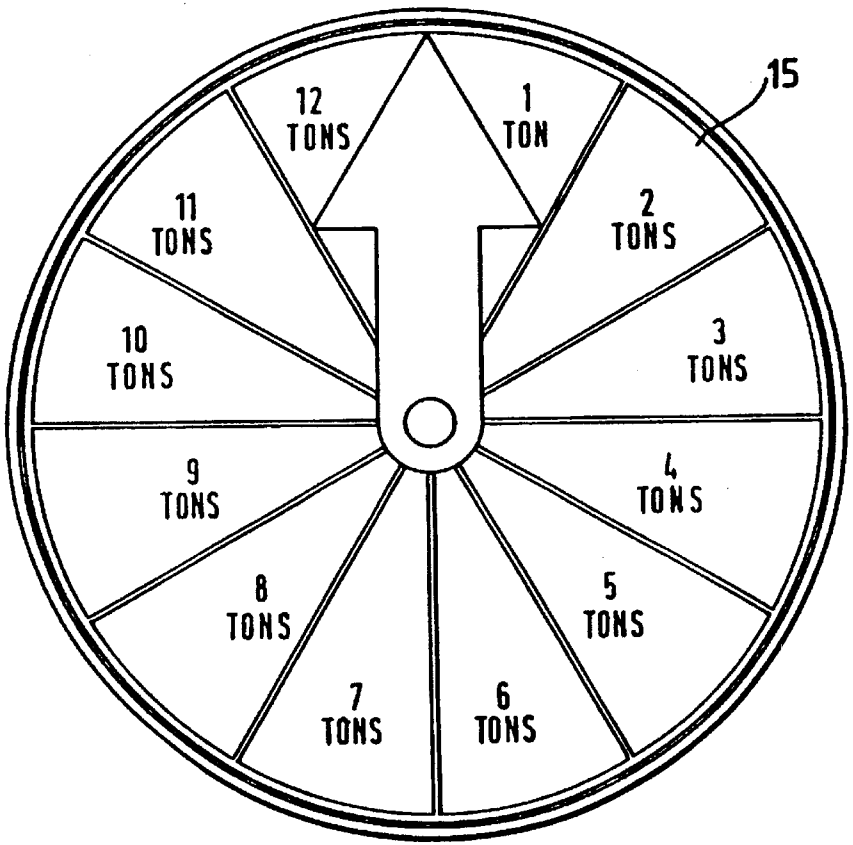
Figure 7:
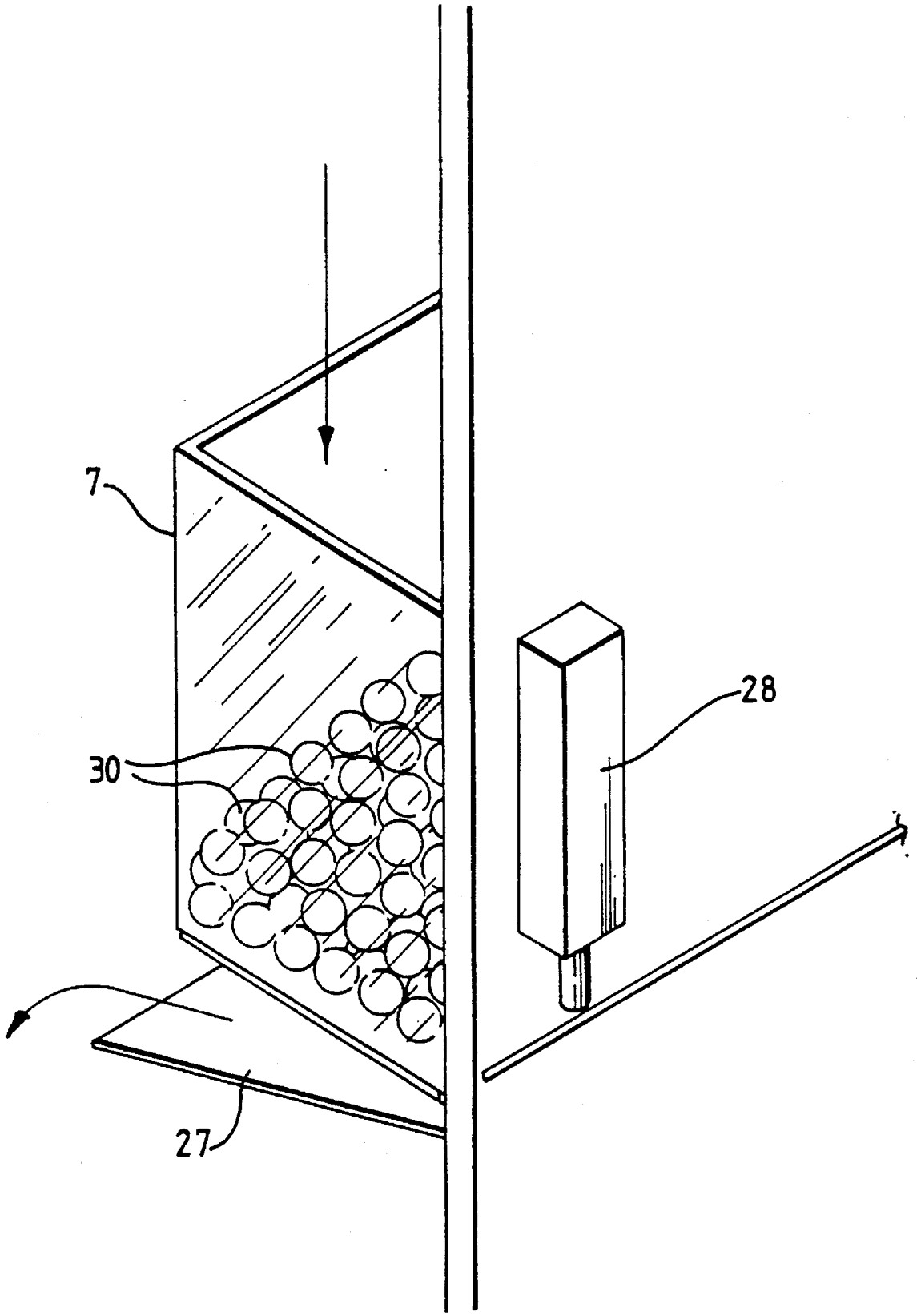

FIGS. 6(A)–6(B) show "tonnage" and "fuel" dials, which display information to the user; and FIG. 7 shows the function of the collector hopper (collection station) and release flap.

The concept of the game for which the machine is used is to scoop balls 30 from a play area 3 by means of a digger arm 4. The user of the machine operates the digger arm 4 to pass the balls into a collector chute 5, from which they are taken by means of a conveyor system 6 to a collector hopper 7, which counts how many balls have been collected. The player then receives a cash or non-cash prize, depending on how many balls have been collected within a defined time.

The balls are then released back into the play area, so that the game can be played again.

The machine has an outer casing 1 mounted on wheels 2. Within the casing there is defined a play area 3 in the form of a reservoir in which a large number of balls 30 may be placed, several layers deep. A pneumatic digger arm 4 is remotely operable by the player from outside the casing. The digger arm can be used to scoop up the balls from the play area and transfer them to a collector chute 5. The balls pass down the collector chute 5 onto the lower end of a conveyor system 6 which transfers them upwardly and into a collector hopper 7. The entrance of the collector hopper 7 is large enough to permit entry of the regular small balls, but small enough to prevent entry of a prize capsule. Instead of entering the collector hopper, prize capsules are diverted along a slipway 8 to an opening at the front of the machine.

The machine illustrated is coin-operated. The player inserts suitable coins into a coin slot 9 at the front of the machine. Depending on the coins inserted, the machine is then operable for a fixed time, which is displayed on a "fuel" dial 10, in which time is simulated as fuel. The player can view the play area through a transparent panel 11 in the upper half of the front of the machine. Also at the front there is a console 12, on which respective control levers or pushbuttons 13 and 14 are arranged. The number of balls collected is displayed to the player by means of a "tonnage" dial 15.

The digger arm 4 is pneumatically operated, the machine being provided with an air compressor 16 accessible from the rear of the machine. The digger arm comprises a vertical member 17 which is rotatable in an arc about a vertical axis. Two hinged members 18 and 19 are successively articulated to the vertical member, and a scoop 20 is articulated to the distal end of the member 19 (FIG. 3). A pneumatically operated piston 21 connects the members 17 and 18 and actuates the raising and lowering of the digger arm.

Figure 5A:
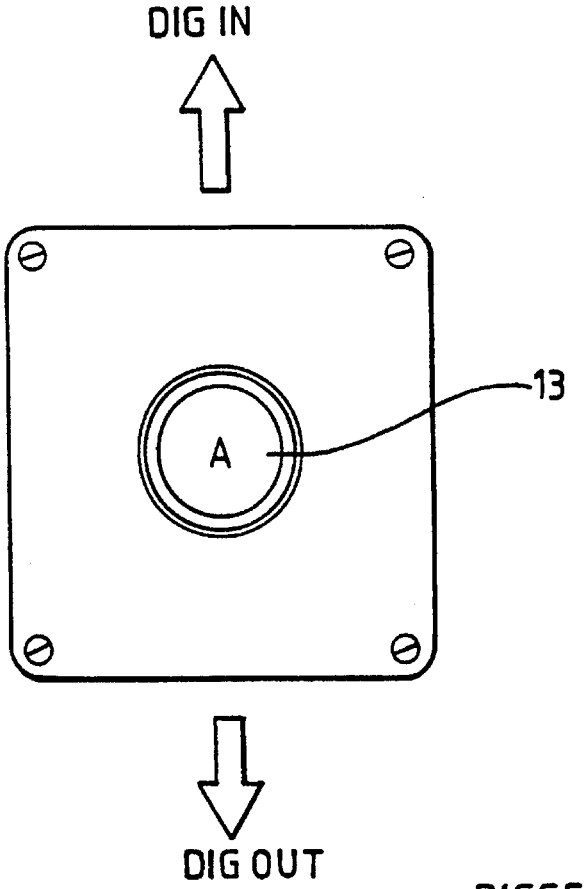
FIGS. 5A and 5B show the operation of respective control levers or pushbuttons by means of which the user of the machine remotely operates the scoop means.
Figure 5B:
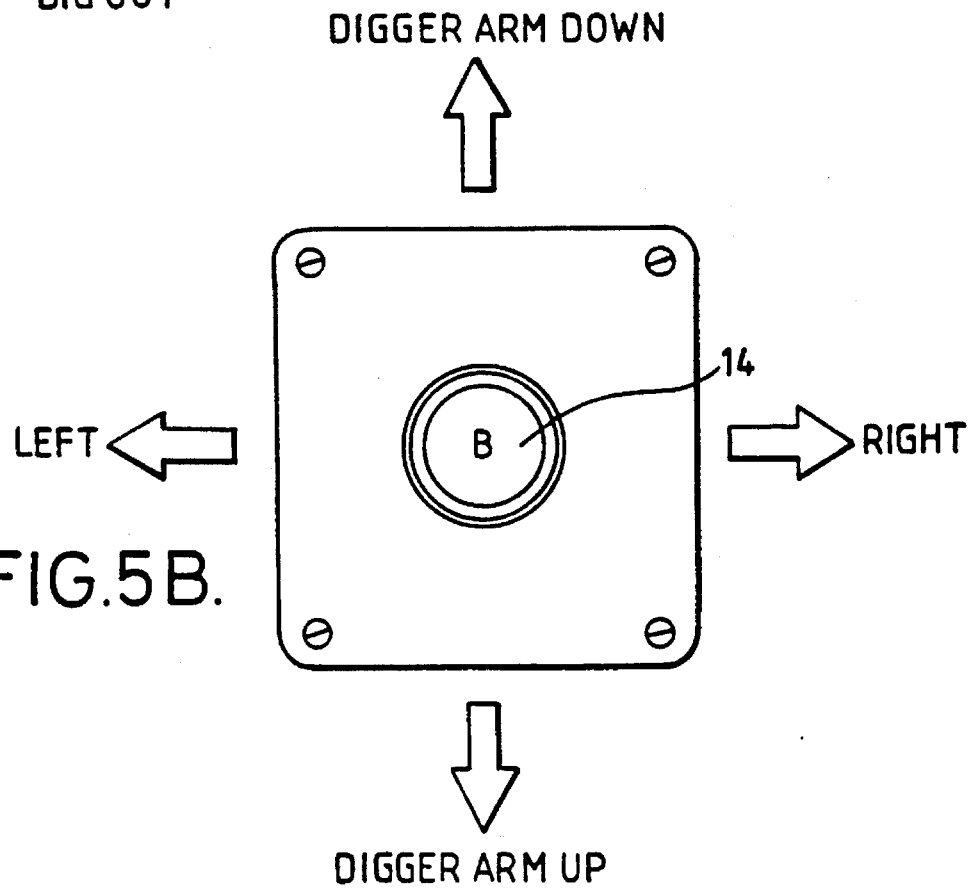

The player controls the digger arm 4 by means of the control levers or pushbuttons 13 and 14 (FIG. 5). The control lever 13 is movable to left and right to control left and right rotation of the vertical member 17, and this may also be achieved by simply pushing the pushbutton to control left rotation and the pushbutton to control right rotation. The control lever 14 is also movable forwards and backwards, to effect downward movement and upward movement, respectively, of the digger arm 4. The control lever 13 is movable forwards and backwards to effect, respectively, pivoting of the scoop 20 towards the player (to scoop up balls from the play area) and pivoting away from the player (to empty balls from the scoop into the collector chute 5). A further pushbutton can be pushed to operate the scoop and backward/forward movement of the arm so as to "dig" the balls in one operation.

Conventional means are provided for actuating the digger arm in the way described in response to the control lever or pushbutton movements, and these are not therefore described in detail.

Figure 1C:
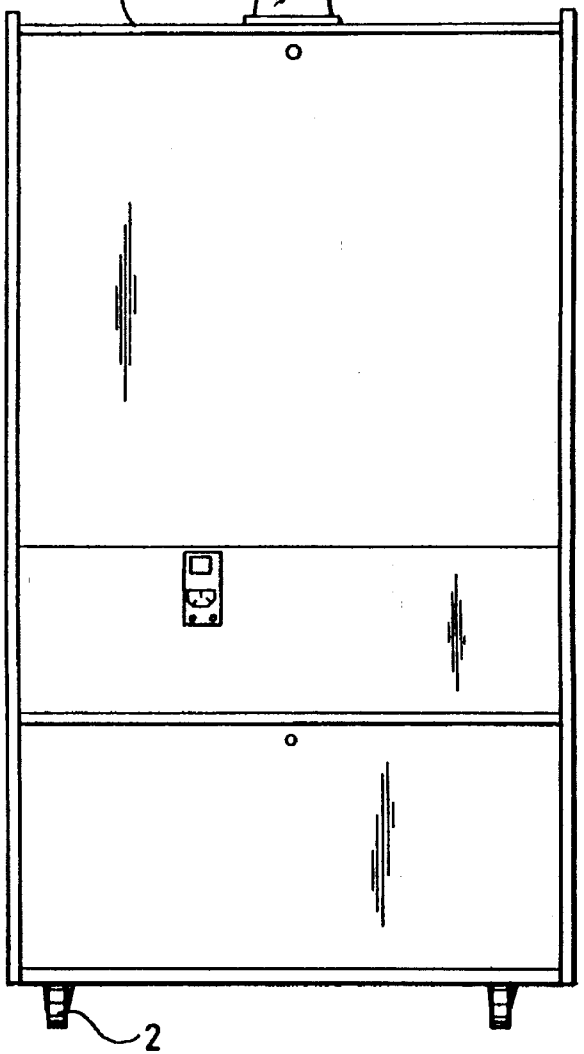
Figure 1B:
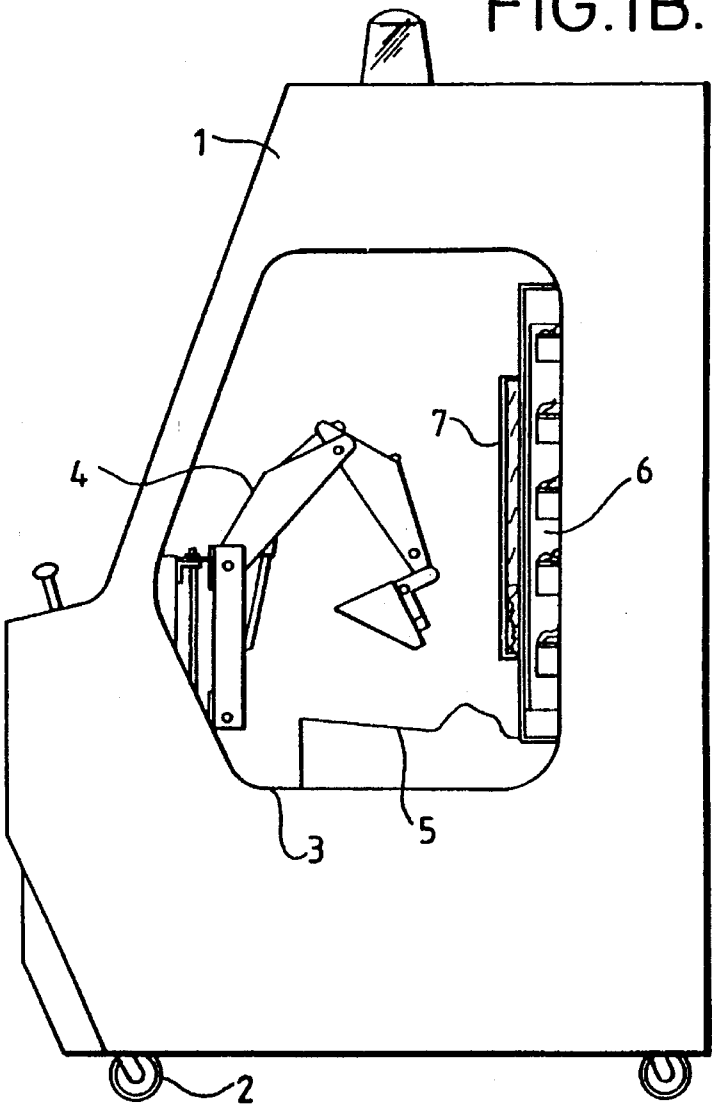
Figure 2C:
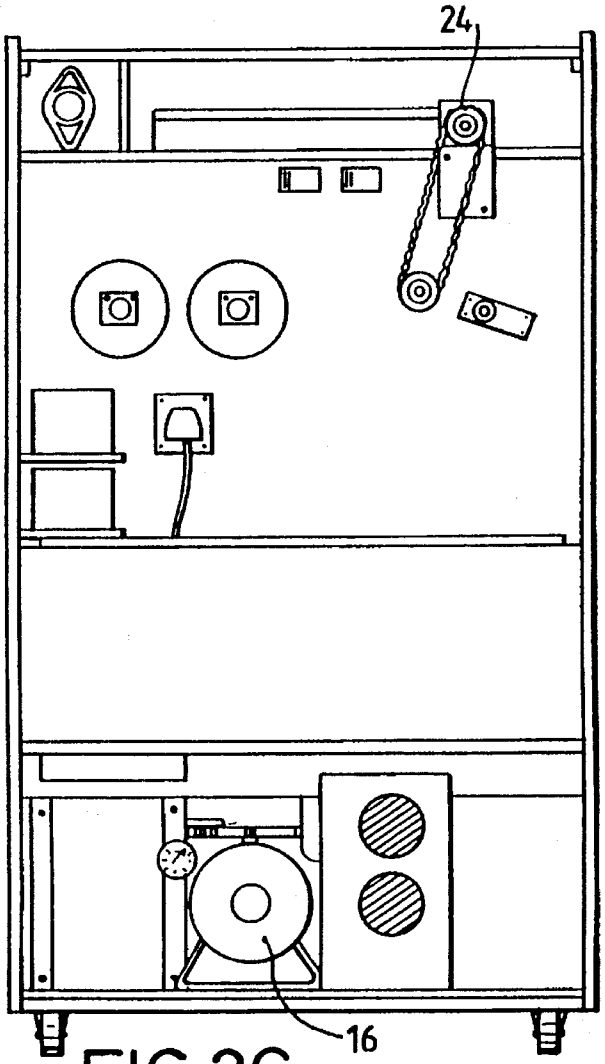
Figure 2B:
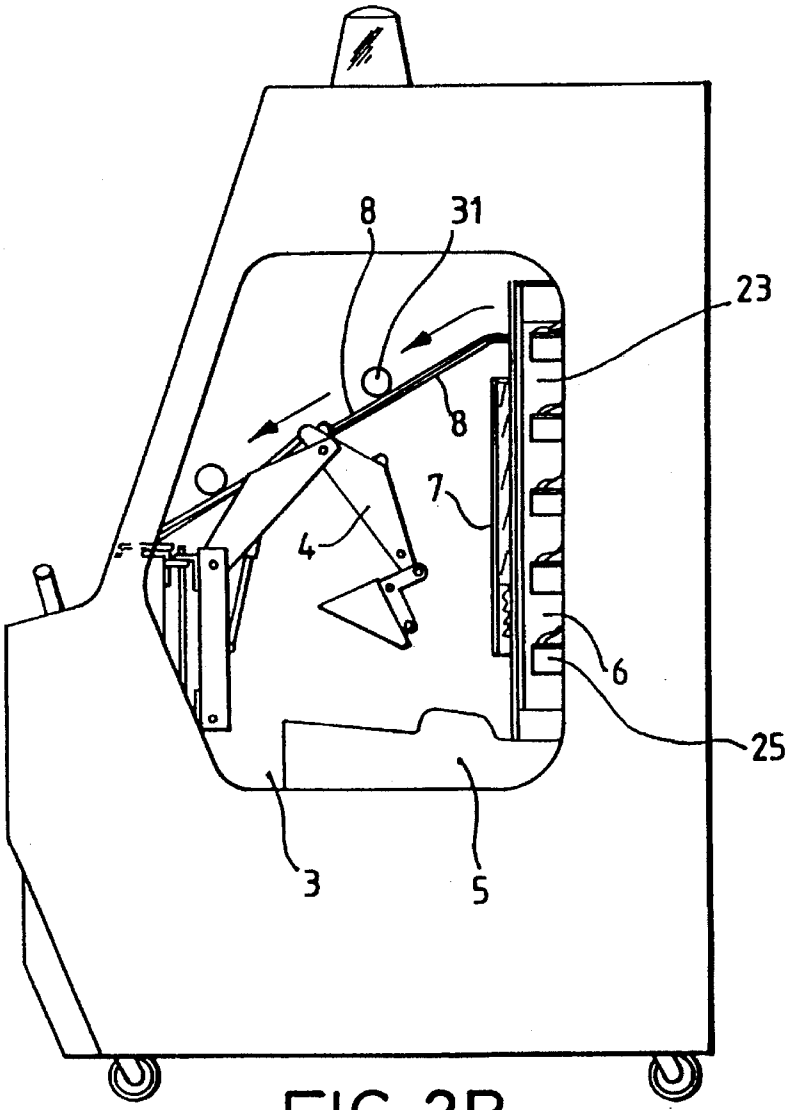
Figure 3A:
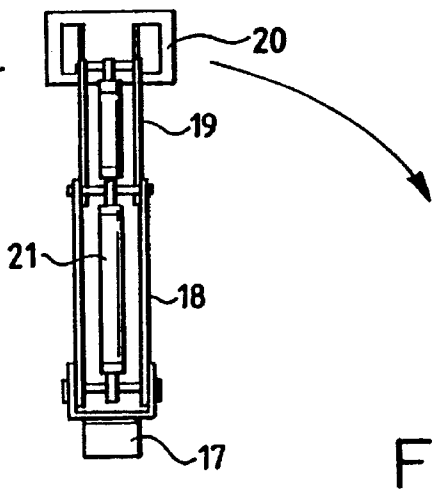
Figure 3C:
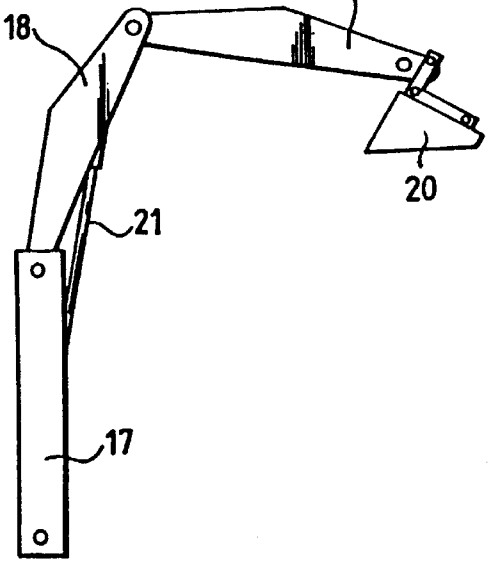
Figure 3D:
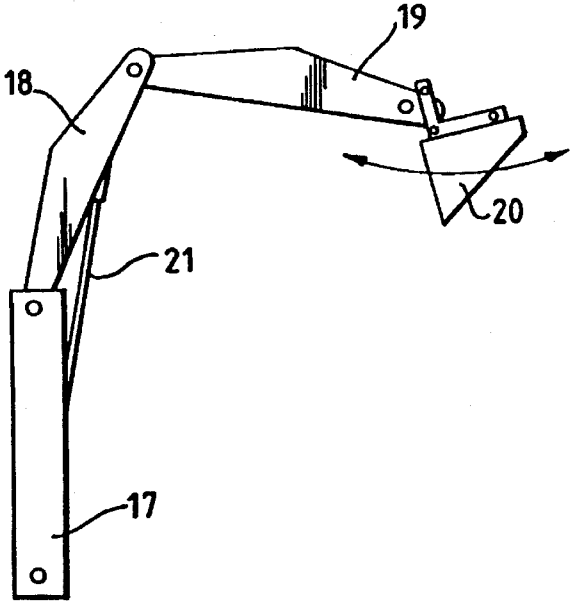
Figure 3B:
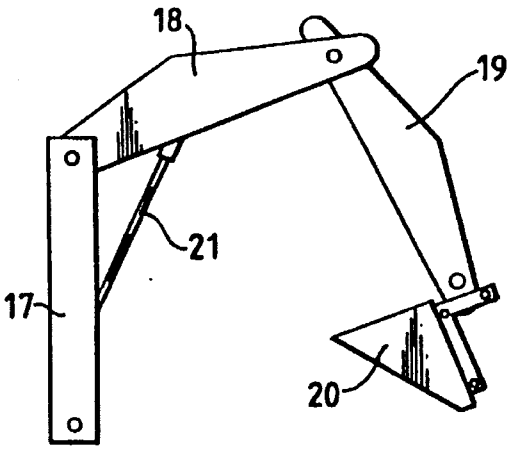
Figure 4A:
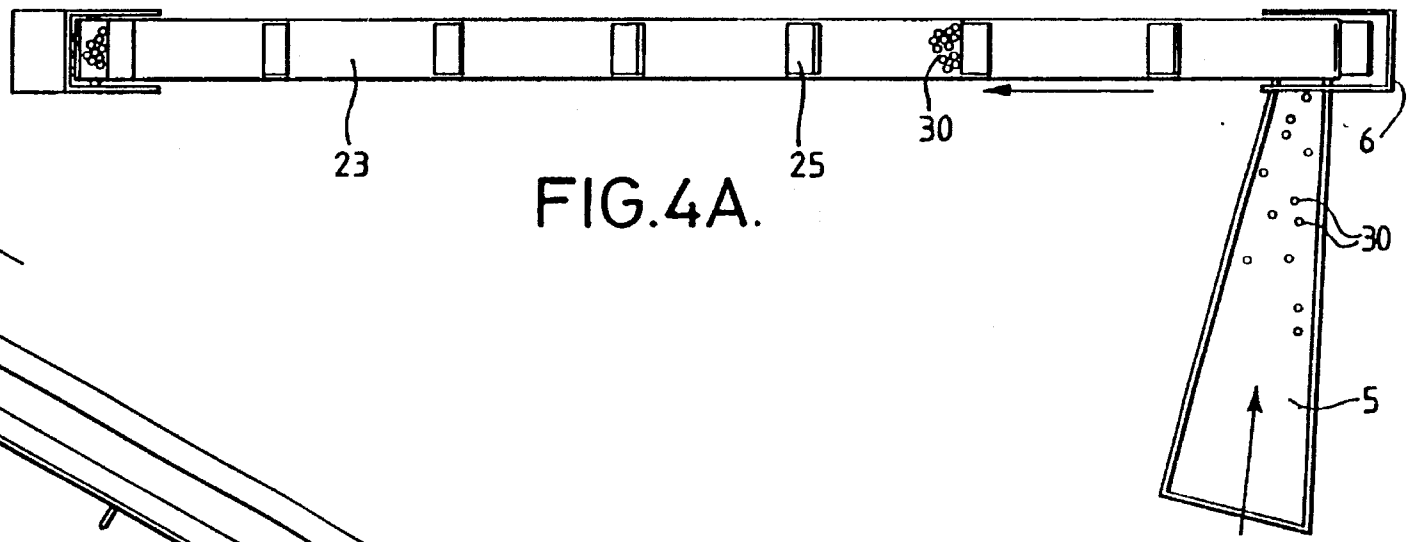
FIGS. 4A and 4B are respectively a plan view and a side view of a conveyor system used in the machine.
Figure 4B:
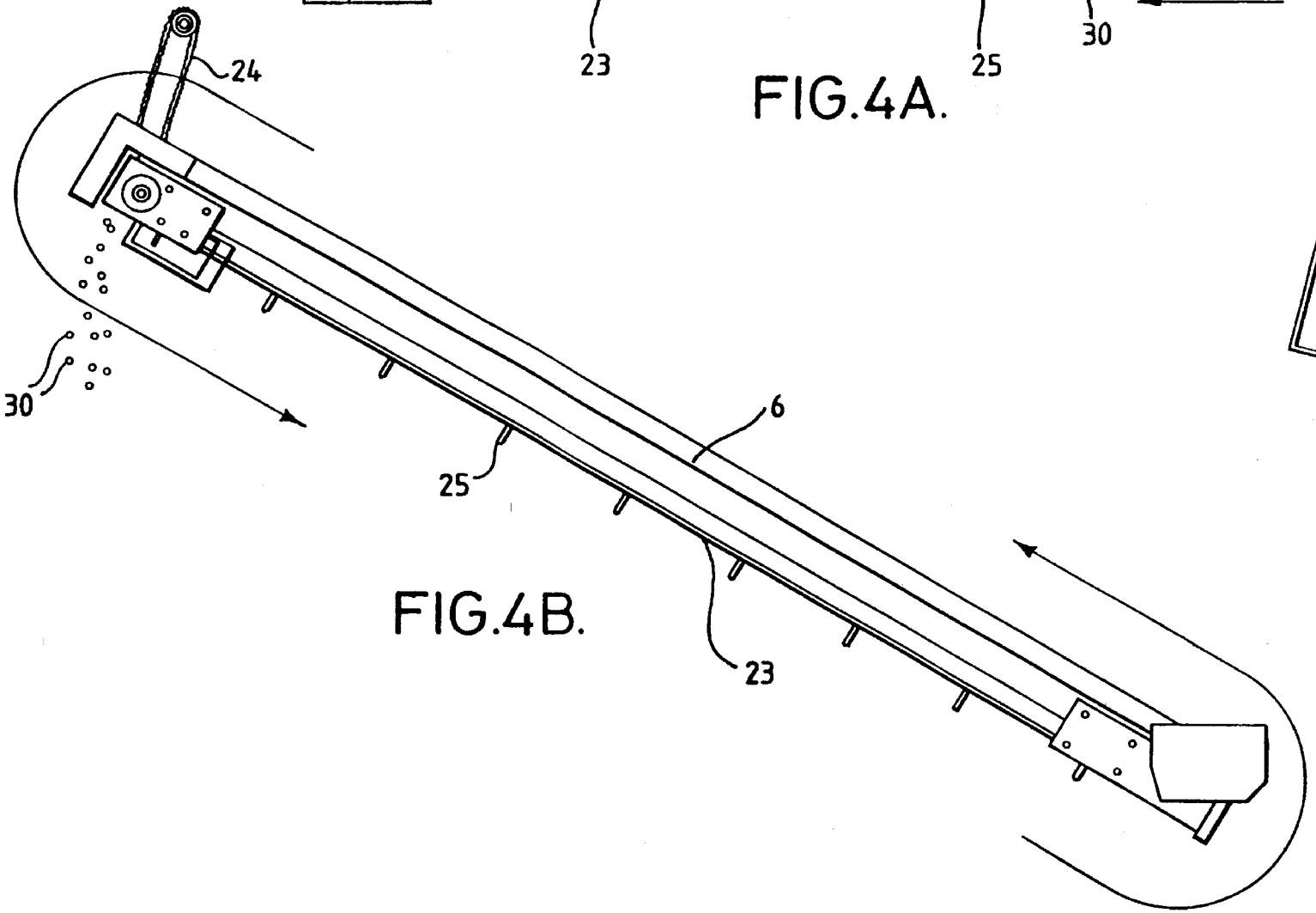

The collector chute 5 slopes downwardly towards the lower end of the conveyor system 6, so that the balls 30 naturally run down the collector chute. The conveyor system 6 comprises a continuous moving belt 23 (FIG. 4) which is driven by a chain drive 24 (FIG. 2C) accessible from the rear of the casing. The belt 23 is provided with regularly spaced stop members 25 which enable balls 30 from the collector chute 5 to be conveyed on the upper surface of the belt. The conveyor system thus transfers the balls upwardly until they fall off the top and down into the collector hopper 7.

A sensor 26 in the collector hopper 7 measures the number of balls collected therein, and simulates this as "tonnes" on the tonnage dial 15. As the game progresses, the player thus receives an indication of the number of balls collected.

The time available to the player for operating the machine depends on the coins inserted. During this time, the control levers or pushbuttons are capable of actuating the digger arm.

When the time expires, a switch breaks the contact between the control levers and the digger arm, so that the machine cannot be operated until more coins are inserted. At this point, the sensor actuates a dispensing means (not shown) for dispensing a prize to the player, which is dependent on the number of balls collected. The prize may be a cash prize, i.e. release of coins from the machine to the player, or a non-cash prize. At this stage, a release flap 27 (FIG. 7) in the base of the collector hopper is actuated by a solenoid 28. This releases the balls from the collector hopper 7 back to the play area 3.

In one embodiment, the prizes are small articles enclosed in clear plastic (e.g. acrylic) balls of diameter larger than the regular balls 30 in the play area. These larger balls are referred to as prize capsules 31. The prize capsules are housed near the top of the internal space in the machine. Under the control of the machine software, when a player has scooped a predetermined number of balls, which are counted by the sensing means 26 at the collection station 7, one or more prize capsules are released onto the play area 3. The player then has a predetermined time, before expiry of the time for operating the machine, to scoop up the prize capsule in the same way as the smaller balls. If he is successful in doing this, the prize capsule will pass to the collector chute 5 and via the conveyor system 6 to the collector hopper 7. Regular small balls collected at the same time will fall into the collector hopper in the usual way, but the prize capsule is designed to be larger than the opening of the collector hopper, and is thus diverted along a slipway 8 to an opening 22 at the front of the machine, where it may be recovered by the player.

We claim:

1. An amusement machine comprising a play area (3) for containing a plurality of small portable articles (3) which are accessible from above; scoop means (4) remotely operable by a user of the machine for scooping articles from the play area (3) and transferring them directly or indirectly to a collection station (7); sensor means (26) for detecting the amount of articles at the collection station (7); a collector chute (5) close to the play (3) for receiving said plurality of articles (3) from the scoop means (4); a conveyor system(6) for receiving said plurality of articles from the collector chute (5) and transporting them into a collector hopper (7) which constitutes the collection station; and dispensing means for dispensing a cash or non-cash prize in response to a signal from the sensor means (26), wherein the scoop meams (4) comprises a rotatable member (17), ptoximal and distal arm members (18, 19) successively articulated to the rotatable member (17), and a scoop (2) articulated to an end of the distal arm member (19), to permit pivoting of the scoop (20) in one direction for picking up said plurality of articles (3) and in an opposite direction for emptying said plurality of articles (3) at the collection station (7).

2. An amusement machine according to claim 1, in which the small portable articles are balls (30).

3. An amusement machine according to claim 2 in which the prize is enclosed in a spherical capsule (31) and is dispensed into the play area (3), from which it may be retrieved by use of the scoop means (4).

* * * * *